US006763921B2

(12) United States Patent
Bruck et al.

(10) Patent No.: US 6,763,921 B2
(45) Date of Patent: Jul. 20, 2004

(54) REDUCED-VIBRATION TUBE ARRAY

(75) Inventors: Gerald J. Bruck, Murrysville, PA (US); Daniel R. Bartolomeo, Monroeville, PA (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 19 days.

(21) Appl. No.: 10/244,067

(22) Filed: Sep. 13, 2002

(65) Prior Publication Data

US 2004/0074724 A1 Apr. 22, 2004

(51) Int. Cl.[7] ..... F16F 7/10
(52) U.S. Cl. ..... 188/378
(58) Field of Search ..... 165/69; 188/378, 188/381; 267/136, 148

(56) References Cited

U.S. PATENT DOCUMENTS 3,294,070 A 12/1966 Bell
4,231,422 A 11/1980 Moranne
4,590,991 A 5/1986 Cooper, Jr. et al.
5,158,162 A 10/1992 Fink et al.
5,713,412 A * 2/1998 Wepfer et al. ..... 165/69

* cited by examiner

*Primary Examiner*—Christopher P. Schwartz

(57) ABSTRACT

A reduced-vibration tube array is disclosed. The array includes a plurality of tubes in a fixed arrangement and a plurality of damping members positioned within the tubes. The damping members include contoured interface regions characterized by bracing points that selectively contact the inner surface of an associated tube. Each interface region is sized and shaped in accordance with the associated tube, so that the damping member bracing points are spaced apart a vibration-reducing distance from the associated tube inner surfaces at equilibrium. During operation, mechanical interaction between the bracing points and the tube inner surfaces reduces vibration by a damage-reducing degree. In one embodiment, the interface regions are serpentine shaped. In another embodiment, the interface regions are helical in shape. The interface regions may be simultaneously helical and serpentine in shape. The damping members may be fixed within the associated tubes, and damping member may be customized several interference regions having attributes chosen in accordance with desired flow characteristics and associated tube properties.

20 Claims, 5 Drawing Sheets

REDUCED-VIBRATION TUBE ARRAY

STATEMENT OF GOVERNMENT INTEREST

The government of the United States of America has certain rights in this invention pursuant to contract no. DE-FC21-95MC32267 awarded by the U.S. Department of Energy.

FIELD OF THE INVENTION

This invention relates generally to the field of vibration reduction and, more particularly, to a reduced-vibration tube array.

BACKGROUND OF THE INVENTION

Tube arrays are bundles of tubes held in a fixed arrangement to provide a discrete path for fluids. These arrangements are useful in a variety of settings, including heat exchangers, catalytic combustion systems, and other industrial process equipment.

Quite often, tube arrays are incorporated into complex systems, such as industrial gas turbine engines or other multi-components environments. As a result, tube arrays can be subjected to large amounts of vibration during use. If left unchecked, this vibration may damage the array. Weld and braze joint failure at tube/support interfaces and fretting wear at points of inter-tube contact are common examples of vibration-induced damage. The vibration may come from a variety of sources, including fluid motion and vibration induced by remote components or other associated hardware. A variety of approaches have been developed in an attempt to reduce the effects of vibration in tube arrays.

One method of reducing tube array vibration involves bracing the array of tubes with external, lateral support members. These support members are typically placed within the array, between the exteriors of adjacent tubes. During operation, these lateral support members impinge upon the outer surfaces of the tubes and reduce vibration. Although external support members may reduce vibration to some extent, they are not suitable in every situation. External supports may, for example, produce locations of unwanted, concentrated wear which can prematurely age the array and, in some cases, may actually cause tube perforations. External supports may also adversely affect the flow of fluids around tube exteriors; this type of flow interruption can be troublesome or even dangerous. In heat exchanger settings, for example, interrupted fluid flow may lead to inefficient transfer of heat, resulting in reduced operational efficiency. Furthermore, in catalytic combustion systems, overly-reduced flow can be catastrophic, leading to failure of components due to inadequate cooling flow or even "flashback" in cases where flow velocity is too low to prevent flames from travelling upstream, into the tube array.

Internally-disposed damping elements have also been employed to reduce tube array vibration. U.S. Pat. No. 5,158,162, issued to Fink et al. ("Fink") and U.S. Pat. No. 4,590,991, issued to Cooper, et al. ("Cooper") are examples of tube arrays that use internally-disposed vibration reducing members. The Fink device discloses a vibration dampener and stiffener apparatus that includes a plurality of flexible, braided cables located within the tubes. As vibration energy is transmitted to the cables, it is transferred into frictional heat energy that radiates from the cables and is dissipated. The Cooper reference discloses a flexible stabilizer for degraded heat exchanger tubing in which an elongated flexible cable or chain is inserted within a tube to be stabilized. With both of these devices, mechanical interaction between the flexible members and tubes reduces vibration within the associated array. Although each approach may reduce vibration in some cases, there still exists the danger of impeded flow, which, as described above, may lead to inefficiencies and can be dangerous.

Although various attempts to reduce vibration within tube arrays have been developed, there are shortcomings which still remain. Accordingly, a need exists in the art for a reduced-vibration tube array assembly that is customizable and which provides desired flow characteristics without producing reductions in effectiveness or reliability. The assembly should dampen vibrations within the array tubes without unduly restricting fluid flow through the array. The assembly should be customizable, allowing strategic, localized variations to account for various aspects of the array tubes. The assembly should also impart desired fluid flow within the array and should transfer vibration energy at multiple transfer locations to provide a distributed transfer of load.

SUMMARY OF THE INVENTION

The instant invention is a reduced-vibration tube array assembly. The assembly includes a plurality of tubes held in a fixed relative relationship and elongated, contoured damping members located therein. The damping members are sized and shaped to permit desired fluid flow rates through the associated tubes. Reduced flow rates may be accommodated by highly-contoured (e.g., tightly spiraled) damping members which provide strategically-selected resistance to flow. Enhanced flow rates may be accommodated by more "flow-transparent" damping members (e.g., members with fewer spirals, having less cross-sectional area, made with perforations, or even made of porous media.) Each damping member is characterized by at least one interface region that has bracing points which contact the inner surfaces of an associated tube during use. During operation of the array, unwanted vibration energy in the tubes is advantageously transferred to the damping members at the bracing points and is dissipated. The bracing points provide multiple locations of contact between the tubes and bracing members, thereby producing a distributed transfer of load. The damping members may be individually customized and may include localized variations to accommodate selected regions of significance within the array. For example, tubes at the periphery of the array may be adjoined on one side by a flat wall rather than by identical tubes. More (or less) dampening may be desired near such a discontinuity. Damping members of different mass or contour may be used advantageously with such periphery tubes. As another example, an unsupported section of a tube with otherwise-discrete locations of support may require increased dampening. A fin-like damping member cold be non-spiraled at the locations of support and tightly spiraled in unsupported regions to yield efficient dampening. In this manner, the interface between the bracing members and the tubes may be customized to provide interaction which will dissipate energy effectively, without damaging the tubes or interfering with the functionality of the array.

Accordingly, it is an object of the present invention to provide a reduced-vibration tube array assembly that is customizable, allowing strategic, localized variations to account for various aspects of the array tubes.

It is another object of the present invention to provide a reduced-vibration tube array assembly that produces desired flow characteristics without producing reductions in effectiveness or reliability.

It is a further object of the present invention to provide a reduced-vibration tube array assembly that dampens vibrations within the array tubes without unduly restricting fluid flow through the array.

It is an additional object of the present invention to provide a reduced-vibration tube array assembly that imparts desired fluid flow within the array.

It is also an object of the present invention to provide a reduced-vibration tube array assembly that transfers vibration energy at multiple transfer locations to provide a distributed transfer of load.

It is additionally an object of the present invention to provide a reduced-vibration tube array assembly that produces supplemental securement of the tubes to the tubesheet.

It is yet another object of the present invention to provide a reduced-vibration tube array assembly that produces enhanced mixing of internal and external tube fluids downstream of their exits.

Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

DETAILED DESCRIPTION OF THE INVENTION

Figure 1:
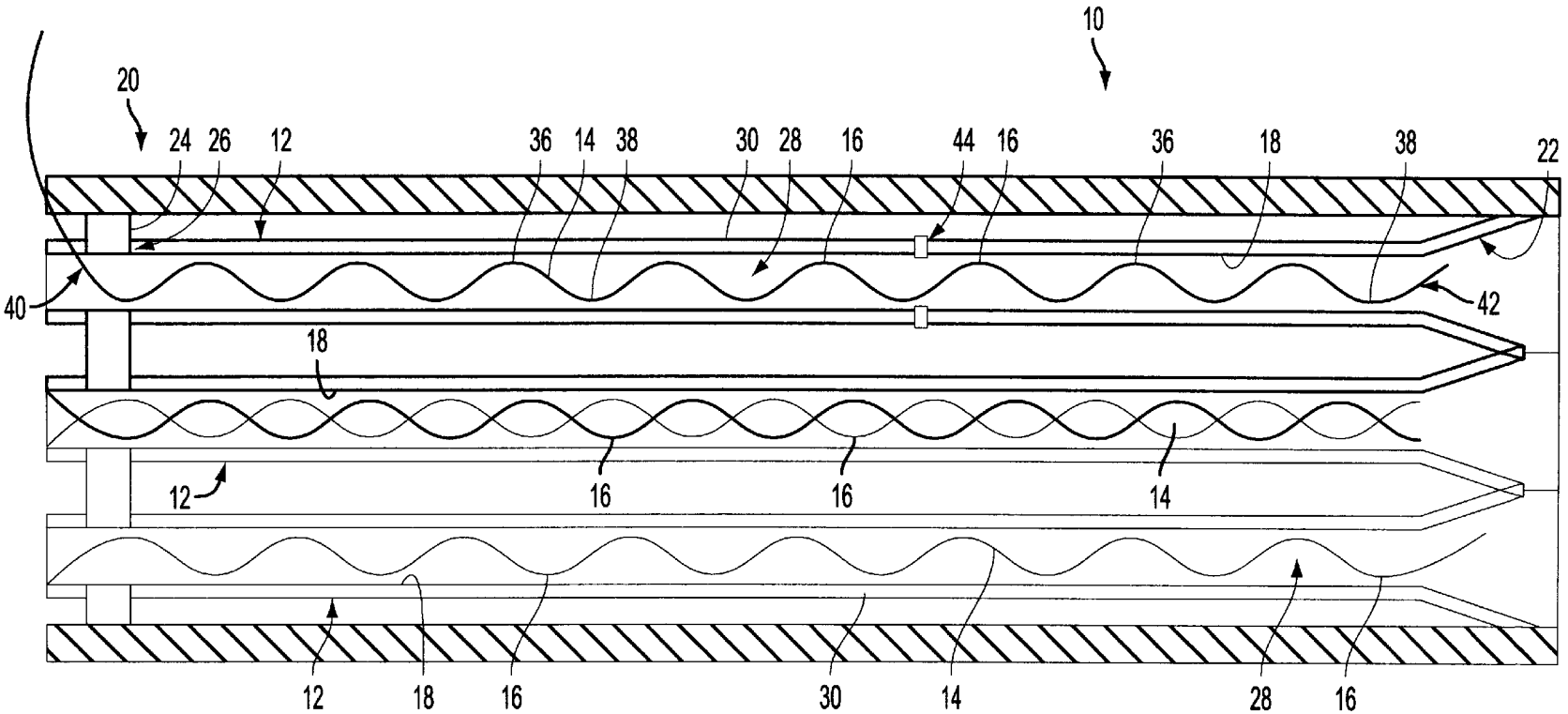
FIG. 1 is a partial side view of the reduced-vibration tube array of the present invention shown in use.

Reference is now made in general to the Figures, wherein the reduced-vibration tube array 10 of the present invention is shown. By way of overview, and with particular reference to FIG. 1, the array 10 includes a collection of elongated tubes 12 held in a fixed arrangement and a plurality of damping members 14 associated therewith. As seen with additional reference to FIG. 2A, the damping members 14 are positioned within the tubes 12, and each damping member is characterized by bracing points 16 that strategically contact the inner surface 18 of the corresponding tube 12. During use, contact between the tube inner surfaces 18 and associated damping member 14 bracing points 16 dissipates vibration energy. The invention will be described in detail below.

For clarity purposes, the damping members 14 and tubes 12 of the present invention will be discussed in a heat exchanger setting, shown in FIG. 1, in which heat is transferred between a first fluid (not shown) flowing inside the tubes 12 and a second fluid (not shown) flowing around the tube exteriors 30. However, it is to be understood that the tubes 12 and damping members 14 may be used in a variety of tube settings, including catalytic combustion systems, and other "industrial process" arrays, including boilers, radiators, and steam generators (not shown), while providing the advantages and benefits described herein.

Figure 2A:
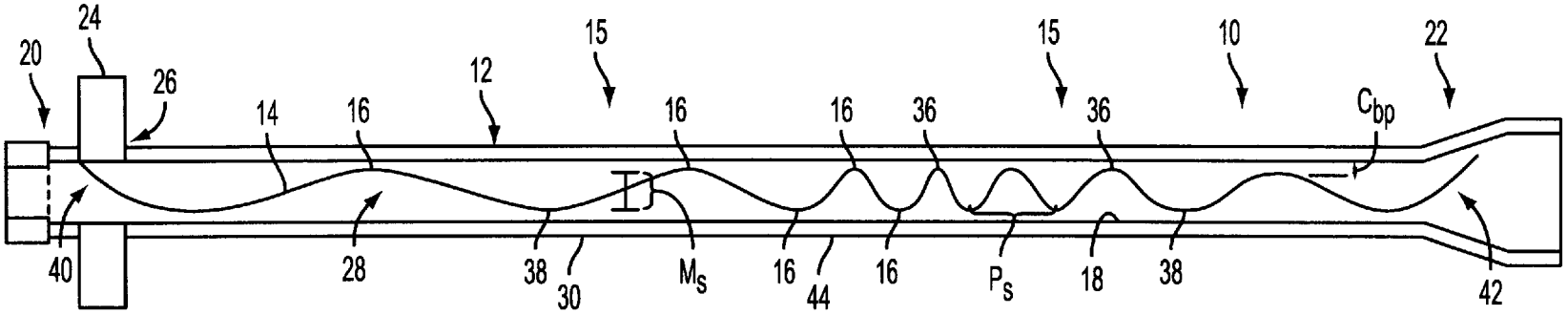
FIG. 2A is a partial side view of the reduced-vibration tube array of the present invention.

As seen with continued reference to FIG. 1, the tubes 12 of the present invention 10 are rigid, substantially-hollow cylinders each having a first end 20 and an opposite second end 22. With reference to FIG. 2A, the tubes 12 are held in a fixed relative arrangement by one or more perforated tubesheets 24. The tubes 12 extend through positioning apertures 26 disposed within the tubesheets 24 and are preferably fixed in place with respect to the tubesheets by welding, brazing, or other suitable method of attachment, including soldering, swaging and explosion bonding, for example.

Although the tubes 12 have been described as cylindrical, the tubes need not be circular in cross section; other geometries may be selected as needed. It is also noted that in some cases, multiple sections of tube 12 may be joined in series to form a tube of extended length. It is further noted that the tubes need not be straight; the tubes may have a variety of contours as desired for a given application. Non-straight tubes might be used, as in a U-tube heat exchanger, for example.

The damping members 14 of the invention 10 will now be discussed. With particular reference to FIG. 2A, the damping members 14 are elongated strips sized and shaped to fit inside the tubes 12 with minimal clearance, so that vibration is reduced by a damage-reducing degree during operation of the array 10. More particularly, each damping member 14 includes at least one interface region 15 that is characterized by bracing points 16 selectively spaced apart from the tube inner surfaces 18 at equilibrium. The equilibrium clearance $C_{bp}$ between a given tube inner surface 18 and the bracing points 16 of a given interface region 15 is, as will be described more fully below, strategically chosen in accordance with properties of the tube 12 in which the damping member 14 is positioned. Interface regions 15 of a given damping member 14 may span the entire length of the member, or may be substantially shorter. Additionally, each damping member 14 may have more than one interface region 15, with each region possibly having different characteristics, as described below.

In this application, the term "minimal clearance" will have an average value of about 0.003 inches and could vary from about 0.000 inches to about 0.006 inches. Additionally, the term "damage-reducing" will refer to vibration reductions ranging from a factor of about three to about five. The Applicant has found that the present invention 10 reduces vibration by a factor of about 3 with equilibrium clearances $C_{bp}$ of about 0.000 to about 0.003 inches, while equilibrium clearances $C_{bp}$ of about 0.006 inches reduced vibration by a factor of about 5. Although larger clearances could be used to create more damping, the Applicants recognize that beyond this value, tube rattling becomes an issue and may cause unwanted wear inside the tube. Furthermore, if the clearance is too large, dampening effects start to lessen, as a result of reduced interaction between the tube and insert.

In one embodiment, shown in FIG. 2A, the interface region 15 has a serpentine cross section and resembles one or more "s-shaped" curves connected end-to-end. In this embodiment, the damping member interface region 15 has multiple peaks 36 and valleys 38, collectively referred to as apexes, that provide the above-mentioned bracing points 16 for contacting the inner surface 18 of the tube in which the damping member is housed. Serpentine geometry would be particularly suited to a variety of settings, including for example, situations where it is important to avoid rotation of fluid inside of and/or exiting the tube. In such cases, serpentine geometry would advantageously provide wave-like, as opposed to rotational, motion. Serpentine geometry would be of advantage in settings where non-symmetric insert mass distribution was desired to dampen vibrations of particular orientation; the serpentine geometry could concentrate mass on an axis by, for example, employing a high ratio between peak-to-valley magnitude and insert width. Serpentine geometry would also be advantageous for use in non-circular tubes; the insert proportions could be strategically modified to fit a variety of non-circular profiles, including oval or polygonal, for example.

The proportions of these serpentine interface regions 15 may be customized as needed to suit various operating environments, and localized variations may advantageously be made to accommodate non-uniform conditions within a given tube 12 or array 10.

One adjustable aspect of the damping members 14 is the location of the bracing points 16 within the interface regions 15. For example, while the bracing points 16 may be distributed uniformly, inserts having different cycle lengths or periods could provide regions of varying bracing point density. The bracing points 16 may also be strategically positioned to coincide with significant locations or elements within the array 10, including tubesheets, baffle plates, inter-tube supports, tube bulges, and tube flares. For example, the damping member contours 36,38 may be modified to provide enhanced contact through welding or other types of mechanical fixing at (or near) tube/tubesheet interfaces 26, or tube segment joints 44. Damping member contours 36,38 may also be strategically varied near areas of discontinuity or tube imperfection. That is, the peak 36 and valley 38 properties including, but not limited to, magnitude $M_s$ and period $P_s$ may be customized to accommodate array tubes 12 as needed. For example, adjusting peak and valley magnitude $M_s$ will provide desired clearance $C_{bp}$ between the tube inner surfaces 18 and bracing points 16. Similarly, varying peak and valley period $P_s$ will provide various bracing point concentrations. It is also noted that the interface region 15 need not include peaks and valleys; a substantially-planar region that includes arcuate sections each having one apex or peak 36 may also be used.

The quantity of bracing points 16 may also be adjusted to provide sufficient contact to dampen vibrations within a given array, while allowing the head loss or flow characteristics to be customized. For example, relatively-large numbers of bracing points 16 may be used in situations where maximum dampening is required or where inner-tube flow rate reductions (brought about by increased flow resistance) are desired. In a related manner, relatively-fewer bracing points would be used when minimal dampening or maximum flow rate are desired.

Figure 2B:
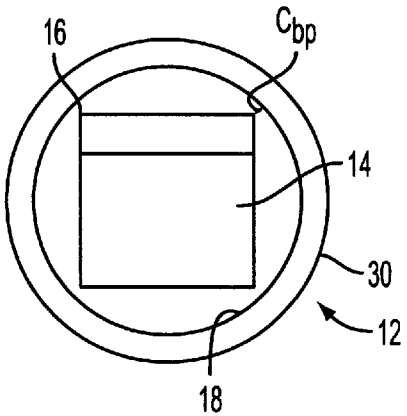
FIG. 2B is a partial end view of the reduced-vibration tube array of the present invention.
Figure 3A:
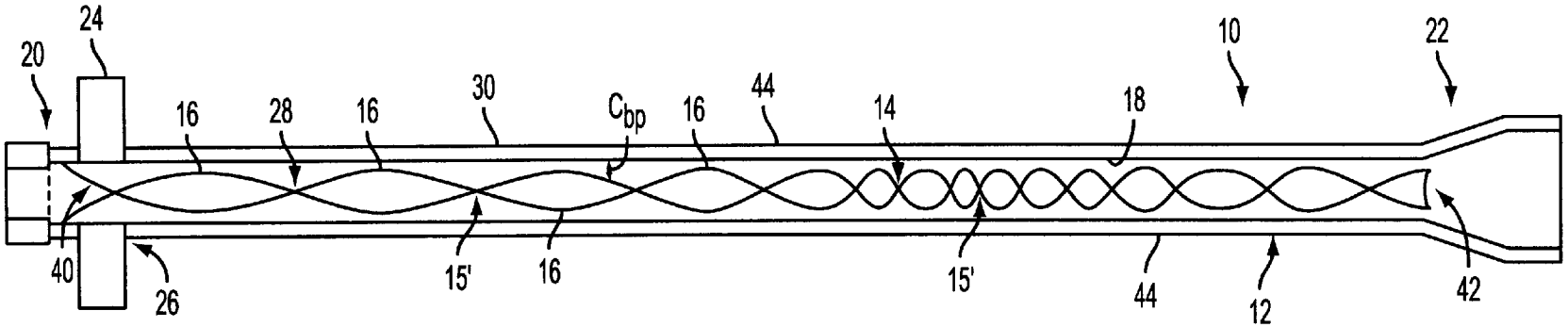
FIG. 3A is a partial side view of the reduced-vibration tube array, including an alternate embodiment of a damping member interface region.
Figure 3B:
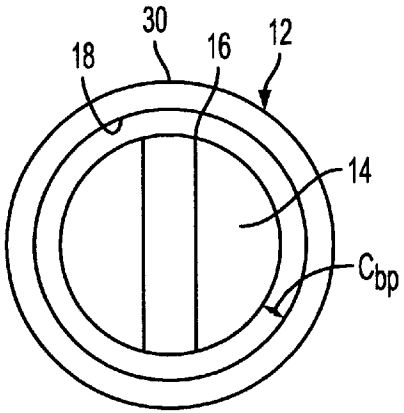
FIG. 3B is a partial end view of the reduced-vibration tube array, including the damping member interface region shown in FIG. 3A.

The interface regions 15 need not have the ribbon-like shape shown in FIGS. 2A and 2B; other shapes may also be employed. For example, as shown in FIGS. 3A and 3B, the interface regions 15' may also be twisted, thereby having a cross section that resembles a screw or helix. Inserts 14 having a twisted orientation would provide bracing points 16 distributed about the tube circumference and along the tube length. With this arrangement, the inserts 14 would be especially suited for dampening randomly-oriented vibrations. Insert pitch could be varied from one complete twist in a fraction of an inch to one twist spread out over many inches. This variability makes twisted inserts 14 well-suited for accommodating damping requirements that vary between tubes 12, or even within a given tube. A typical pitch for this interface region 15 would vary between about four complete twists per inch to about one-tenth of a twist per inch. It is noted that twisted inserts 14 provide relatively-high amounts of damping due to evenly-distributed points of contact 16 with a given tube 12. The location of contact changes in accordance with selected pitch, but the amount of contact changes little for a given insert radius. Furthermore, varying the clearance $C_{bp}$ between the tube 12 and insert 14, will advantageously change the amount of damping without altering the uniformity of contact.

As with the serpentine interface regions 15 described above, parameters of the twisted or helical interface regions 15' may be varied to produce a variety of flow and contact characteristics. For example, the amount of pitch or twist may be selected to accelerate fluid flow in a given area, such as near a tube joint or other locations of surface imperfections. Twisted inserts 14 having customized pitches might provide, among other results, regions of low resistance to enhance flow near walls surrounding the tube array or other regions similarly characterized by areas of discontinuity.

It is further noted that twist may be strategically imparted with a first direction, such as right-handed or "clockwise", in some interface regions 15' and a second direction, such as left-handed or "counter-clockwise" in others, so that a particular desired fluid mixing can occur downstream of the tube array 10.

It is also noted that, an equilibrium or at rest clearance $C_{bp}$ between the bracing points 16 and tube inner surfaces 18 may be individually adjusted to provide desired flow and contact properties. As noted above, the damping members 14 may include more than one interface region, and each region may have different properties.

It may be desirable to have essentially-continuous contact between the entire edges of a given twisted insert 14 and associated tube 12 in cases where heightened damping is required. With such an arrangement, the effective mass of the damped tube 12 will increase and heightened frictional energy transfer may advantageously be accomplished. In practice, this type of contact may be achieved, among other ways, by employing a twisted insert 14 having a coefficient of thermal expansion higher than that of the associated tube 12. During operation, the components will heat up and produce a snug fit. In such applications, the damping member 14 should be chosen from a material which wears in a manner equal to or greater than the tube 12.

Figure 4:
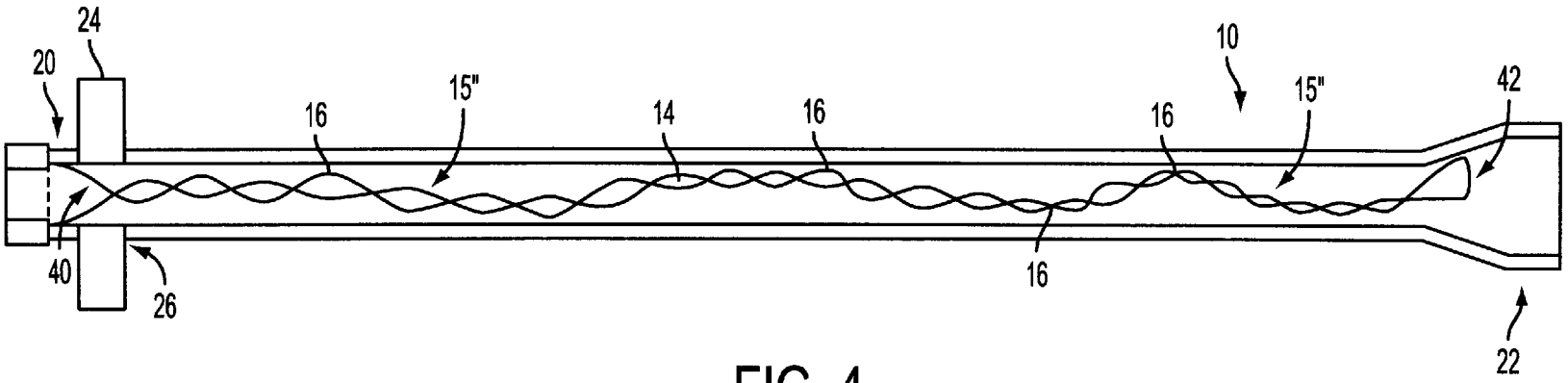
FIG. 4 is a partial side view of the reduced-vibration tube array, including an alternate embodiment of a damping member interface region.

Various shapes may be combined within a given interface region. For example, as shown in FIG. 4, an interface region 15" may be both twisted and serpentine. Such an arrangement would be useful in tubes 12 having noncircular (for example, oval) cross-sections, where helical-only inserts would not provide a desired fit, but where rotational motion of fluid, which would not be provided by a serpentine-only insert, is desired. As a result, the damping members 14 of the present invention are highly customizable and allow a great deal of control over the amount of damping and flow properties at localized areas. This arrangement provides customized damping and produces fluid flow properties that complement the characteristics of the tubes 12 to be damped.

The damping members 14 may be formed from a variety of materials. In some settings, especially where corrosion is an issue, it is desirable for the damping members 14 and tubes 12 to be constructed from materials such as stainless steel or nickel-based alloys. In situations where enhanced wear resistance is desired, materials such as cobalt-based alloys, including Haynes Ultimate Alloy (UNS No. R31233) and Haynes Alloy 6B (UNS No. R30016), may be used for the damping members 14 and/or tubes 12. Other materials may be chosen as necessary to accommodate the anticipated dynamics associated with operation of the array 10 or to meet requirements imposed by fluids, e.g., thermal shock resistance, associated with operation of the array 10 or to meet requirements imposed by fluids, e.g. oxidation resistance, carburization resistance, which the array will transmit.

Each damping member 14 may be fixed longitudinally with respect to the tube 12 in which it is housed. In one embodiment, as shown in FIG. 2A, the first end 40 of each damping member 14 is attached to the corresponding tube 12 through a crimping arrangement. More particularly, the damping member first end 40 is attached to the associated tube first end 20. However, the location of attachment need not be confined to the tube and damping member first ends 20,40. The damping members 14 may also be joined with an associated tube 12 via crimps located within or adjacent to, and at both upstream and downstream ends of, a selected positioning aperture 26 and end 22, thereby providing a supplemental method of fixing the tubes 12 with respect to the tubesheet 24.

It is noted that crimping is not the only suitable method of positioning the damping members 14. A variety of attachment methods may be used, including welding, brazing, or other methods appropriate for the operating environment and selected materials.

With continued reference to FIGS. 2A and 2B, the second ends 42 of the damping members 14 are preferably free, but may be attached to the associated tubes 12. Additionally, the second ends 42 of the damping members 14 may be flared to promote desired flow characteristics including, among others, laminar flow. It is also noted that, multiple points of attachment may be used, and in some cases, the damping members 14 may be inserted into the tubes 12 but not fixed in place.

During operation, fluid flow and interaction with other components (not shown) may produce vibration within the array 10, shifting the damping members 14 from an equilibrium state to a dynamic state. In the dynamic state, relative motion between the damping members 14 and tubes 12 causes bracing points 16 in the interface regions 15,15', 15" to impact the tube inner surfaces 18. As noted above, with this impact, vibration energy is dispersed to the damping members 14 and dissipated by a damage-reducing amount. Additionally, because each damping member 14 preferably includes a multitude of bracing points 16, the energy is advantageously transferred in a distributed manner.

Figure 5A:
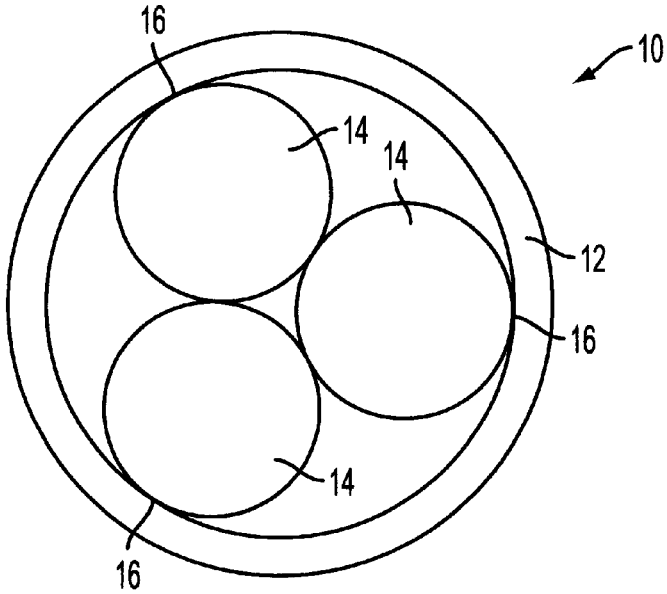
FIG. 5A is a partial end view of an alternate embodiment of the reduced-vibration tube array.
Figure 5B:
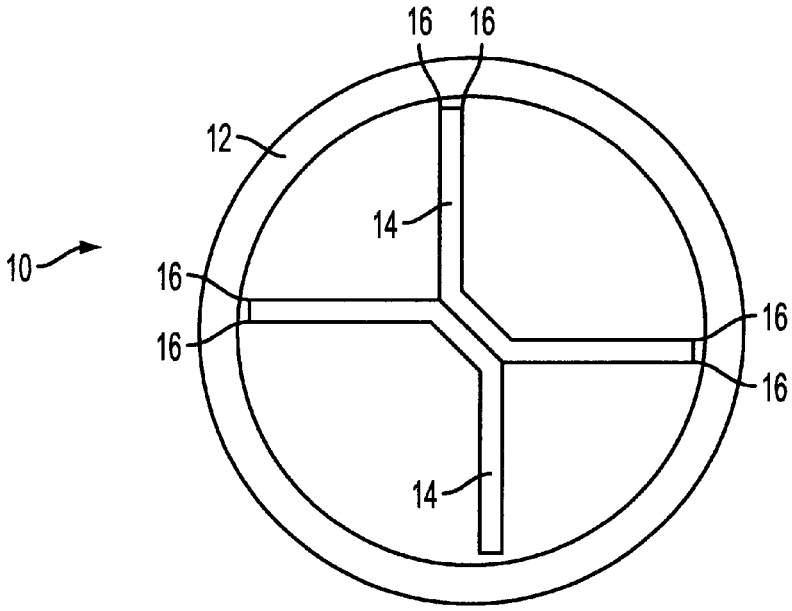
FIG. 5B is a partial end view of an alternate embodiment of the reduced-vibration tube array.

It is also noted that the number and geometry of the dampening members 14 may be varied in accordance with desired flow requirements. As seen in FIGS. 5A and 5B, arrangements having low flow resistance and multiple contact points 16 may be produced.

It is to be understood that while certain forms of the invention have been illustrated and described, it is not to be limited to the specific forms or arrangement of parts herein described and shown. It will be apparent to those skilled in the art that various, including modifications, rearrangements and substitutions, may be made without departing from the scope of this invention and the invention is not to be considered limited to what is shown in the drawings and described in the specification. The scope if the invention is defined by the claims appended hereto.

What is claimed is:

1. A reduced-vibration tube array comprising:

a plurality of tubes in a fixe arrangement, each tube having an inner surface;

a plurality of tunable damping members each positioned within a corresponding one of said tubes;

each damping member resembling an elongated strip having a first contoured interface region characterized by predetermined quantity of bracing points for selectively contacting said inner surface of said corresponding tube, said first interface region being sized and shaped in accordance with said tube such that said bracing points of said first interface region are spaced apart a predetermined, first vibration-reducing distance from said tube inner surface at equilibrium;

whereby mechanical interaction between said bracing points located on said elongated strip and said tube inner surface is effective to reduce vibration by a damage-reducing degree and whereby said damping members are adapted to impart desired fluid flow and mechanical interaction properties selected in accordance with predetermined tube parameters.

2. The reduced-vibration tube array of claim 1, wherein said first interface region is substantially-serpentine, being characterized by a plurality apexes.

3. The reduced vibration tube array of claim 2, wherein at least one of said damping members is fixed in place with respect to said corresponding one of said tubes.

4. The reduce vibration tube array of claim 3, wherein said at least one damping member is fixed via a crimped relationship with said a corresponding one of said tubes.

5. The reduced vibration tube array of claim 2, wherein said apexes are spaced longitudinally in accordance with at least one attribute selected from the group consisting of damping optimization and flow resistance control.

6. The reduced vibration tube array of claim 2, wherein said apexes are spaced radially in accordance with at least one attribute selected from the group consisting of optimized mass distribution of said damping member and vibration-controlling spacing of said damping members.

7. The reduced vibration tube array of claim 2, wherein said first interface is substantially-helical shaped, being further characterized by a predetermined pitch.

8. The reduced-vibration tube array of claim 2, wherein a first of said plurality of damping members has a right-handed pitch and a second of said plurality of damping members has a left-handed pitch.

9. The reduce-vibration tube array of claim 1, wherein said first interface region is substantially-helical shaped, being characterized by a predetermined pitch.

10. The reduce-vibration tube array of claim 9, wherein said predetermined pitch is selected in accordance with at least one attribute selected from the group consisting of damping optimization, flow resistance control, and flow rotation control.

11. The reduced-vibration tube array of claim 10, wherein at least one of said damping members is fixed in place with respect to said corresponding one of said tubes.

12. The reduced-vibration tube array of claim 11 wherein said at least one damping members is fixed via a crimped relationship with said corresponding one of said tubes.

13. The reduced-vibration tube array of claim 1, wherein said first interface region is arcuate, being characterized by at least one apex having a predetermined magnitude.

14. The reduced-vibration tube array of claim 13, wherein said predetermined magnitude is selected in accordance with at least one attribute selected from the group consisting of optimized mass distribution of said damping member and vibration-controlling spacing of said damping members.

15. The reduced-vibration tube array of claim 14 wherein at least one of said damping members is fixed in place with respect to said corresponding one of said tubes.

16. The reduced-vibration tube array of claim 15, wherein said at least one damping member is fixed via a crimped relationship with said a corresponding one of said tubes.

17. The reduced-vibration tube array of claim 1, wherein at least one of said damping members includes a second contoured interface region characterized by a predetermined quantity of bracing points for selectively contacting said inner surface of said corresponding tube, said second interface region being sized and shaped in accordance with said tube such that said bracing points of said second interface region are spaced apart a second predetermined, vibration-reducing distance from said tube inner surface at equilibrium.

18. The reduced-vibration tube array of claim 17, wherein said second vibration-reducing distance rang from between about 0.000 inches to about 0.006 inches.

19. The reduced-vibration tube array of claim 1, wherein at least one of said damping members includes a flared end.

20. The reduced-vibration tube array of claim 1, wherein said first vibration-reducing distance ranges from between about 0.000 inches to about 0.006 inches.

* * * * *